US010525527B2

(12) United States Patent
Fujikawa

(10) Patent No.: US 10,525,527 B2
(45) Date of Patent: Jan. 7, 2020

(54) INJECTION MOLDING MACHINE

(71) Applicant: Sodick Co., Ltd., Kanagawa (JP)

(72) Inventor: Misao Fujikawa, Kanagawa (JP)

(73) Assignee: Sodick Co., Ltd., Kanagawa (JP)

( * ) Notice: Subject to any disclaimer, the term of this patent is extended or adjusted under 35 U.S.C. 154(b) by 0 days.

(21) Appl. No.: 15/822,209

(22) Filed: Nov. 27, 2017

(65) Prior Publication Data

US 2018/0154431 A1 Jun. 7, 2018

(30) Foreign Application Priority Data

Dec. 7, 2016 (JP) ..... 2016-237413

(51) Int. Cl.
*B22D 17/20* (2006.01)
*B22D 17/32* (2006.01)

(52) U.S. Cl.
CPC ..... *B22D 17/203* (2013.01); *B22D 17/2038* (2013.01); *B22D 17/32* (2013.01)

(58) Field of Classification Search
CPC .. B22D 17/20; B22D 17/203; B22D 17/2038; B22D 17/32
USPC ..... 164/303, 312
See application file for complete search history.

(56) References Cited

U.S. PATENT DOCUMENTS

| | | | |
|---|---|---|---|
| 5,370,518 A | 12/1994 | Sasaki et al. | |
| 5,500,166 A | 3/1996 | Sasaki et al. | |
| 6,187,229 B1 | 2/2001 | Takayama et al. | |
| 2006/0042772 A1 * | 3/2006 | Fujikawa | B22D 17/10 164/312 |

FOREIGN PATENT DOCUMENTS

| | | |
|---|---|---|
| DE | 19646432 | 4/2004 |
| JP | H05220801 | 8/1993 |
| JP | 2003126951 | 5/2003 |
| JP | 2004195527 | 7/2004 |
| JP | 2005199335 | 7/2005 |

OTHER PUBLICATIONS

"Notification of Reasons for Refusal of Japan Counterpart Application," dated Jan. 5, 2018, with English translation thereof, p. 1-p. 6.

Office Action of China Counterpart Application, with English translation thereof, dated Jun. 10, 2019, pp. 1-17.

* cited by examiner

*Primary Examiner* — Kevin P Kerns

(74) *Attorney, Agent, or Firm* — JCIPRNET

(57) ABSTRACT

There is provided an injection molding machine including a backflow prevention device configured to perform a backflow prevention operation in which the communication path is closed to prevent a backflow of the molten material. The backflow prevention device includes a sealing seat that is provided in the communication path, a valve rod that is movable to come in contact with the sealing seat, and a fitting portion in which the sealing seat as an end is fitted to the valve rod. The backflow prevention operation includes at least one pumping operation in which a front of the valve rod moves from a position at which the front is not fitted to the fitting portion to a position at which the front comes in contact with the sealing seat.

11 Claims, 7 Drawing Sheets

INJECTION MOLDING MACHINE

CROSS-REFERENCE TO RELATED APPLICATION

This application claims the priority benefit of Japan application serial no. 2016-237413, filed on Dec. 7, 2016. The entirety of the above-mentioned patent application is hereby incorporated by reference herein and made a part of this specification.

BACKGROUND OF THE INVENTION

Field of the Invention

The present invention relates to an injection molding machine. Specifically, the present invention relates to an injection molding machine suitable for injection molding in which a molding material is a light metal.

Description of Related Art

An injection molding machine injects a predetermined amount of a molten material metered in an injection device into a cavity of a mold. In an injection molding machine that includes a melting device in which a molding material melts to generate a molten material and an injection device including an injection shaft which injects the molten material supplied from the melting device, a connecting member connecting the melting device and the injection device is provided. The molten material generated in the melting device is sent to the injection device through a communication path in the connecting member.

Since a predetermined pressure is applied to the molten material by the injection shaft during injection, it is necessary to close the communication path during injection in order to prevent the molten material from flowing back to the melting device through the communication path.

Here, an injection molding machine including a backflow prevention device configured to prevent a backflow of a molten material by bringing a valve rod into contact with a sealing seat formed in the communication path is known. Specifically, in Patent Literature 1, when a front of a valve rod is cooled, a semi-solid material in which the molten material is solidified halfway is generated, and the backflow is prevented.

PRIOR ART DOCUMENT

Patent Documents

[Patent Document 1] Japanese Unexamined Patent Application, No. 2005-199335

SUMMARY OF THE INVENTION

However, in the backflow prevention device of the related art, heat of the molten material is excessively absorbed by the valve rod, the fluidity of the molten material decreases in the vicinity of the communication path. Therefore, there is a case where the molten material does not appropriately flow from the melting device to the injection device when backflow prevention is released. In particular, when the valve rod is cooled as in Patent Literature 1, such a problem is likely to occur.

The present invention has been made in view of the above circumstances, and the present invention provides an injection molding machine in which, when a backflow prevention operation is performed, a pumping operation in which a front of the valve rod moves from a position at which the front is not fitted to the fitting portion in which the sealing seat as an end is fitted to the valve rod to a position at which the front comes in contact with the sealing seat is performed at least once, and thus the molten material with low fluidity is pushed out to the injection device.

According to the present invention, there is provided an injection molding machine including a melting device in which a molding material melts to generate a molten material, an injection device including an injection shaft which injects the molten material supplied from the melting device, a connecting member including a communication path communicating with the melting device and the injection device, and a backflow prevention device configured to perform a backflow prevention operation in which the communication path is closed to prevent a backflow of the molten material. The backflow prevention device includes a sealing seat that is provided in the communication path, a valve rod that is movable to come in contact with the sealing seat, and a fitting portion in which the sealing seat as an end is fitted to the valve rod. The backflow prevention operation includes at least one pumping operation in which a front of the valve rod moves from a position at which the front is not fitted to the fitting portion to a position at which the front comes in contact with the sealing seat.

In the injection molding machine according to the present invention, when the backflow prevention operation is performed, the pumping operation in which the front of the valve rod moves from the position at which the front is not fitted to the fitting portion to the position at which the front comes in contact with the sealing seat is performed at least once. Accordingly, it is possible to push out the molten material with low fluidity to the injection device. When the backflow prevention is released, it is possible to send the molten material from the melting device to the injection device more suitably.

DESCRIPTION OF THE EMBODIMENTS

Figure 1:
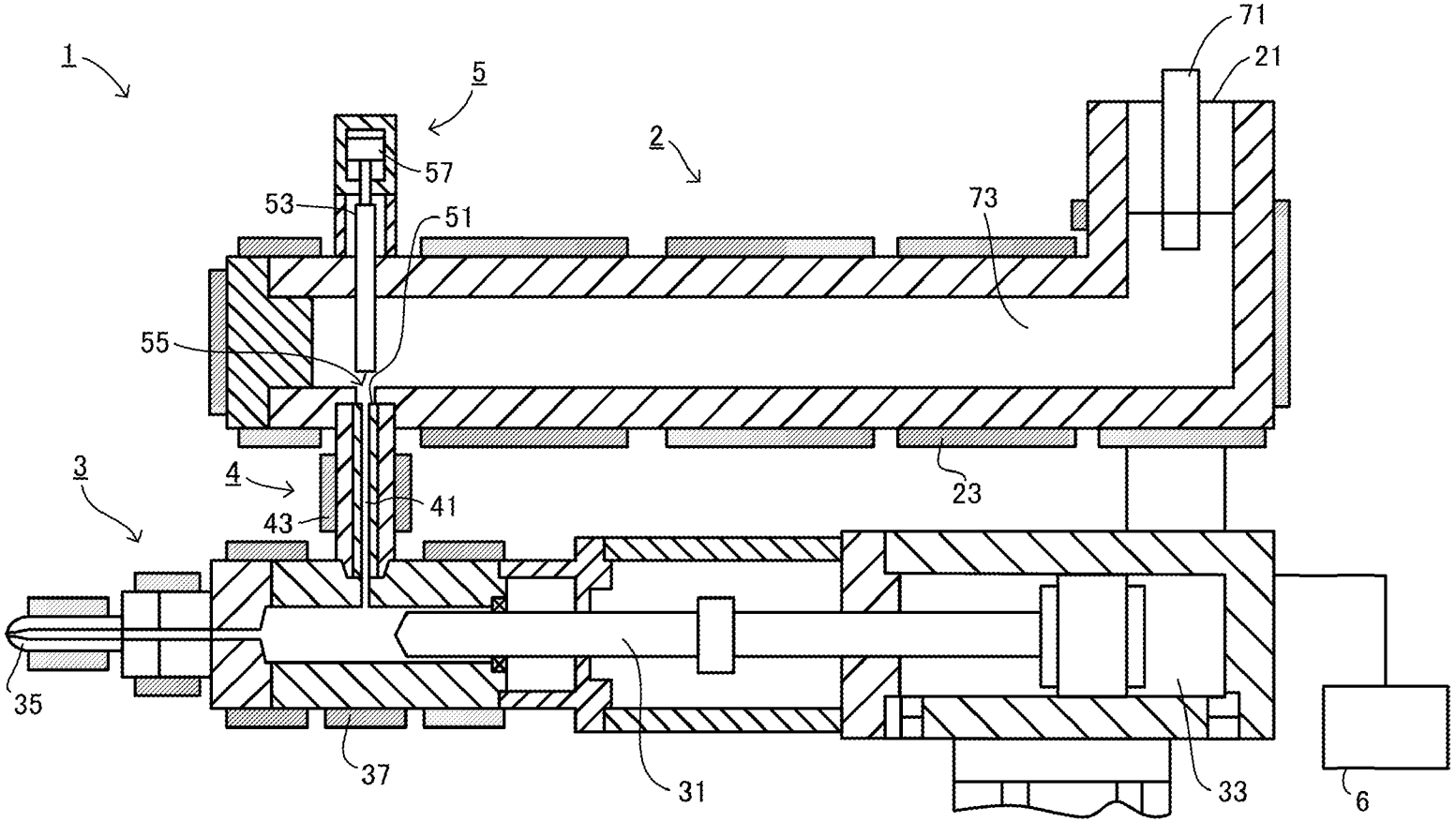
FIG. 1 is a configuration diagram of an injection unit 1 of the present invention.

Embodiments of the present invention will be described below with reference to the drawings. Embodiments and examples in which a plurality of components are modified to be described below can be performed in any combination. Here, in the following description, "front end" refers to a side from which a molten material 73 is injected, and specifically a left side end of a melting device 2 or an injection device 3 in FIG. 1 and FIG. 3. "Rear end" refers to a side to which a molding material 71 is supplied, and specifically a right side end of the melting device 2 or the injection device 3 in FIG. 1 and FIG. 3.

An injection molding machine of an embodiment has a structure suitable for injection molding in which the molding material 71 is a light metal. The light metal in the present invention refers to a metal having a specific gravity of 4 or less and includes not only a pure metal but also an alloy containing additional elements. Practically, in particular, a magnesium alloy or an aluminum alloy is effectively used as the molding material 71. Here, when the molding material 71 is an aluminum alloy, parts in contact with the molten material 73 are basically covered with a cermet based material to prevent erosion.

The injection molding machine of the present invention mainly includes an injection unit 1 configured to melt the molding material 71 and inject a predetermined amount of the molten material 73 into a cavity of a mold, a clamping unit (not shown) configured to open and close and clamp a mold, and a control unit including a control device 6 configured to control operations of the injection unit 1 and the clamping unit.

In the melting device 2, the molding material 71 melts to generate the molten material 73. The melting device 2 includes a cylinder that is disposed horizontally. The molding material 71 is supplied from a material supply port 21 provided on a rear end side of the melting device 2 by a material supply device (not shown). The material supply device may have a configuration in which the molding material 71 is partially melted and supplied in units of a small amount, which is preferable to prevent a rapid decrease in temperature in the vicinity of the material supply port 21. The melting device 2 heats and melts the supplied molding material 71 by a plurality of heaters 23, generates the molten material 73, and sends it forward. The molten material 73 sent to the side of the front end while sufficient heat is applied by the heater 23 is sent to the injection device 3 through a communication path 41 of a connecting member 4 by self-weight of the molten material 73.

The injection device 3 includes a cylinder that is disposed horizontally, and an injection shaft 31 that moves in the cylinder. The injection device 3 operates an injection shaft driving device 33 and retracts the injection shaft 31, and meters out the molten material 73 sent from the melting device 2 to the injection device 3 through the communication path 41 of the connecting member 4. The injection device 3 remains in a predetermined temperature range in which a state in which the molten material 73 is melted can be maintained by a plurality of heaters 37. After the injection device 3 meters the molten material 73, the communication path 41 is closed. Then, the injection device 3 operates the injection shaft driving device 33, and advances the injection shaft 31 to a predetermined position on the injection device 3. When the injection shaft 31 advances to the predetermined position, a predetermined amount of the molten material 73 in the injection device 3 is injected into a cavity of a mold (not shown) from an injection nozzle 35. Here, while the injection shaft 31 is a plunger in this example, other components such as a screw may be used.

The connecting member 4 connects the melting device 2 and the injection device 3. The melting device 2 and the injection device 3 communicate via the communication path 41 in the connecting member 4. The connecting member 4 remains in a predetermined temperature range in which a state in which the molten material 73 is melted can be maintained by the heater 43.

The backflow prevention device 5 includes a sealing seat 51 provided in the communication path 41, a valve rod 53 that is movable to come in contact with the sealing seat 51, a fitting portion 55 in which the sealing seat 51 as an end is fitted to the valve rod 53, and a fluid cylinder 57 such as a hydraulic cylinder which is a valve rod driving device configured to advance and retract the valve rod 53. The fitting portion 55 is a recess that is complementary in shape to the front of the valve rod 53. Here, in this specification, fitting refers to a state in which the front of the valve rod 53 is inserted into the fitting portion 55. A cross-sectional area of the fitting portion 55 is larger than a cross-sectional area of the communication path 41. A slight gap is provided as a clearance between the valve rod 53, and the fitting portion 55 and prevents deterioration due to wear. The communication path 41 is opened by the backflow prevention device 5 when a metering operation starts and is closed immediately before an injection operation is performed. This operation is called a backflow prevention operation.

Figure 2:
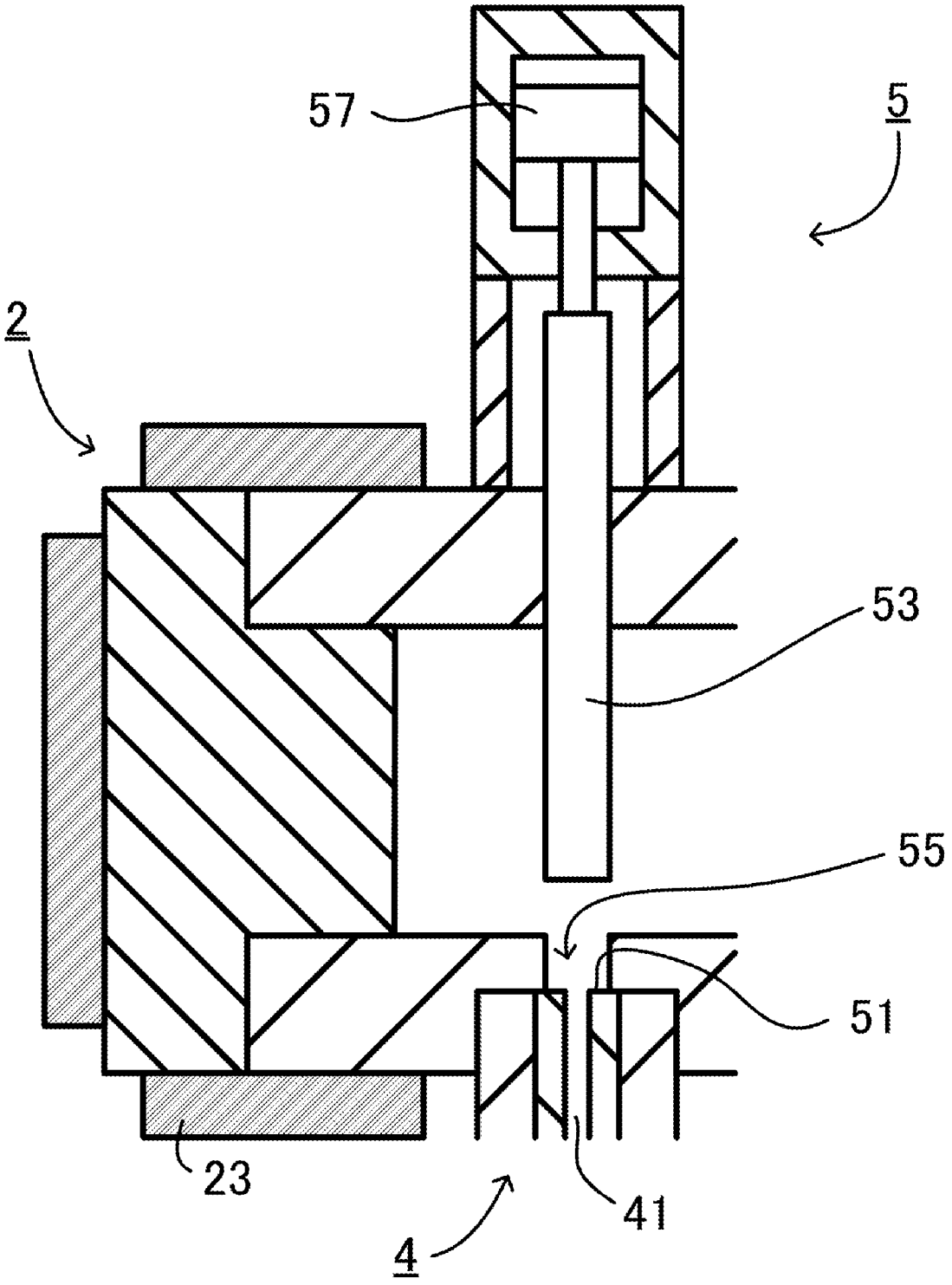
FIG. 2 is an enlarged diagram showing a backflow prevention device 5 in FIG. 1.
Figure 3:
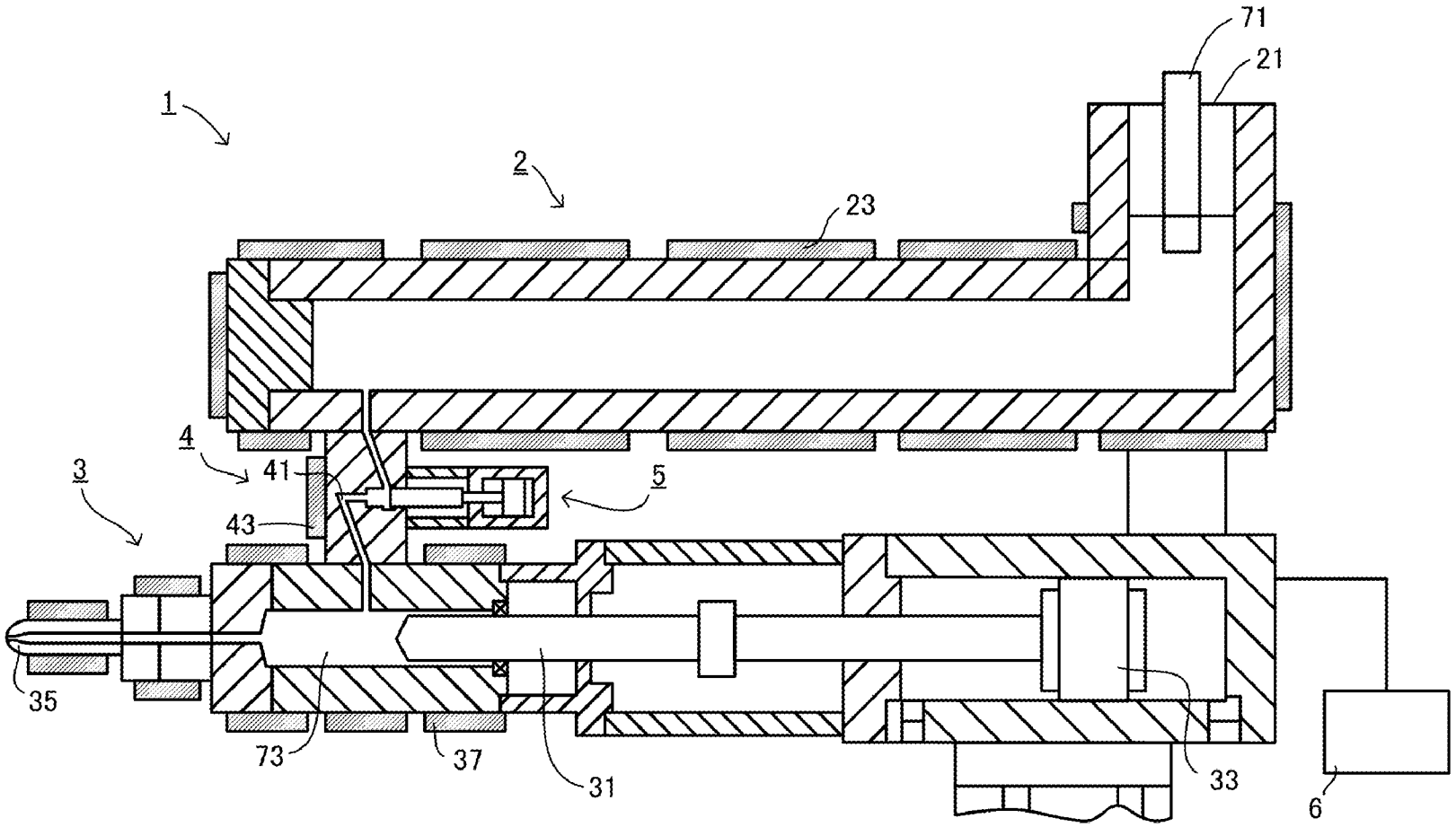
FIG. 3 is a configuration diagram of an injection unit 1 including a backflow prevention device 5 of another example.
Figure 4:
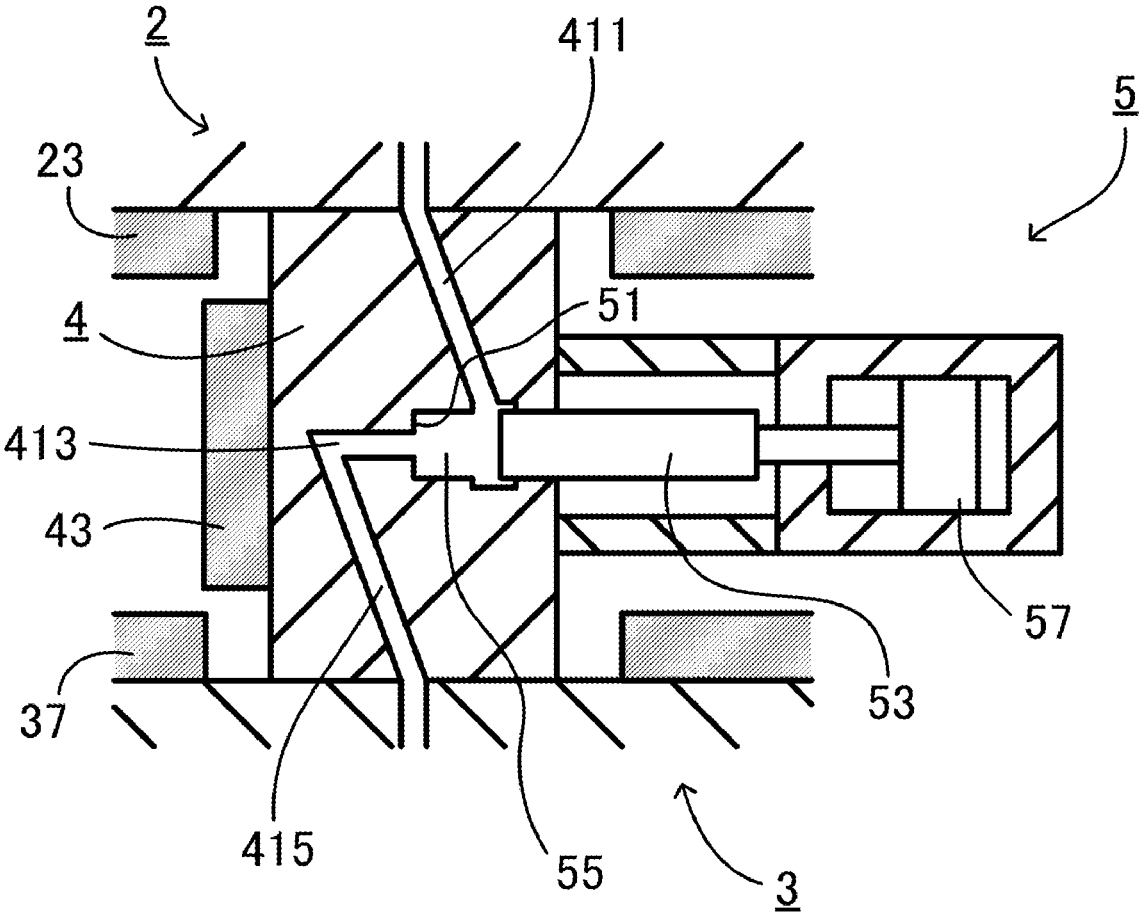
FIG. 4 is an enlarged diagram showing the backflow prevention device 5 in FIG. 3.

The sealing seat 51 may be provided on an end face at a side of the melting device 2 in the communication path 41 as shown in FIG. 1 and FIG. 2 or may be provided at an intermediate portion of the communication path 41 as shown in FIG. 3 and FIG. 4. In the case of the latter, the communication path 41 includes an upper communication path 411 which is connected to the melting device 2, an intermediate communication path 413 which is connected to the upper communication path 411 and in which the sealing seat 51 is provided, and a lower communication path 415 which is connected to the intermediate communication path 413 and the injection device 3. In the example in FIG. 3 and FIG. 4, the backflow prevention device 5 is provided between the melting device 2 and the injection device 3, and thus the injection unit 1 can be relatively reduced in size. While in the example in FIG. 1 and FIG. 2, the fluid cylinder 57 moves the valve rod 53 vertically, in the example in FIG. 3 and FIG. 4, the fluid cylinder 57 moves the valve rod 53 horizontally. The fitting portion 55 faces the valve rod 53 and is formed in the connecting member 4. The upper communication path 411 is connected to the fitting portion 55 and is connected to the melting device 2 at a center of a first connecting surface connecting the melting device 2 and the connecting member 4. The lower communication path 415 is connected to the fitting portion 55 and is connected to the injection device 3 at a center of a second connecting surface connecting the injection device 3 and the connecting member 4. Such a configuration is preferable in consideration of size reduction of the connecting member 4. In addition, while the melting device 2 and the injection device 3 are fastened to the connecting member 4 using a bolt or the like. According to the above structure, tightening torques are uniformly applied to the first connection surface and the second connection surface, respectively. Therefore, it is possible to prevent the molten material 73 from leaking.

Figure 5:
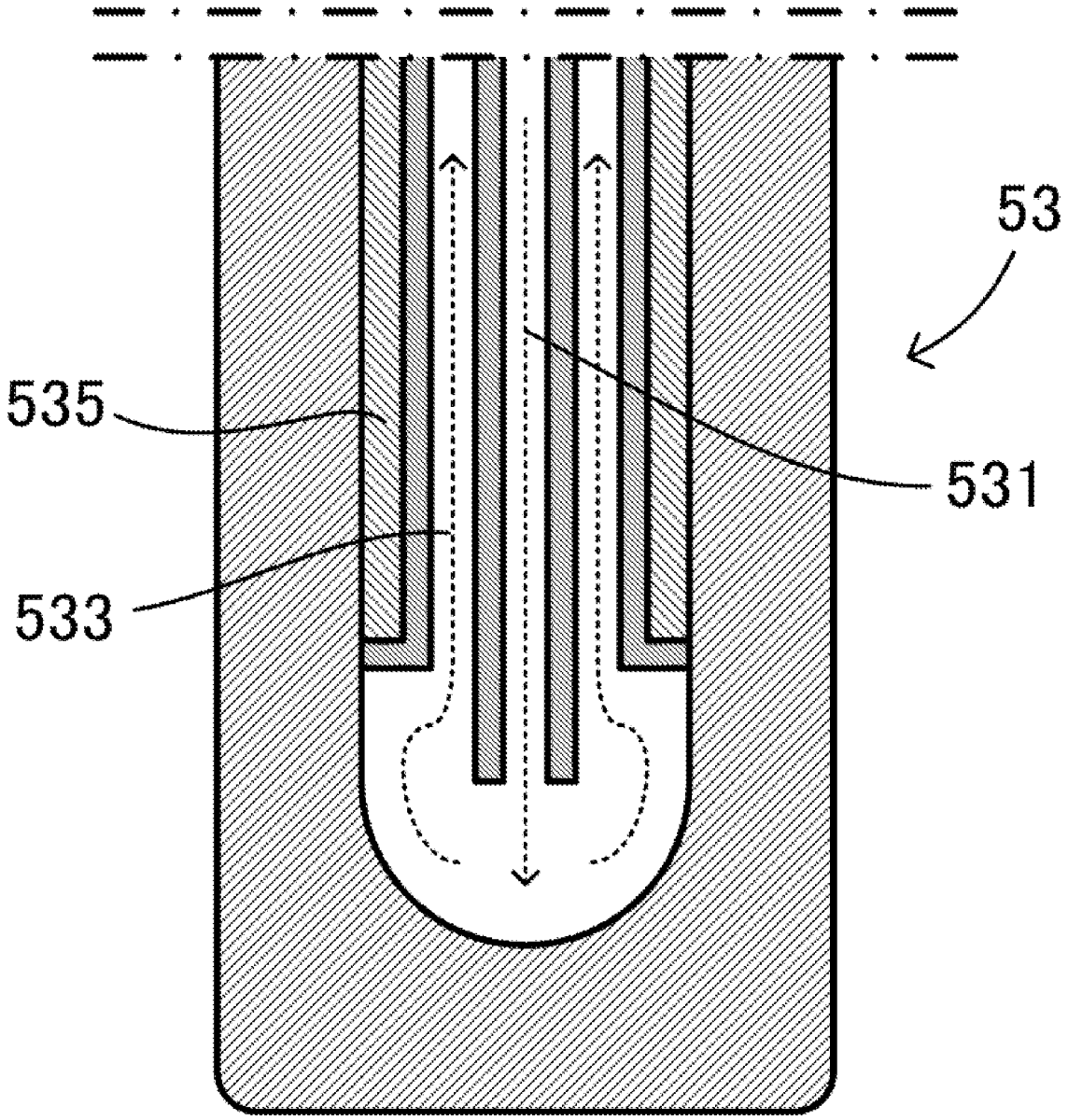
FIG. 5 is a cross-sectional view of a front of a valve rod 53.

The front of the valve rod 53 is preferably cooled, and the temperature of the front is lower than the temperature of the molten material 73 by 30° C. or more and 50° C. or less. As shown in FIG. 5, the valve rod 53 includes a supply pipe 531 serving as a supply path of the refrigerant, a discharge pipe 533 serving as a discharge path of a refrigerant, and an insulation portion 535 which surrounds the supply pipe 531 and the discharge pipe 533 and is made of an insulation material. A flow path of the refrigerant is forming as indicated by dotted arrows. The refrigerant is, for example, compressed air. Accordingly, when the backflow prevention operation is performed, a semi-solid material in which the molten material 73 is solidified halfway can be formed and sealed in the clearance between the valve rod 53 and the fitting portion 55, and it is possible to prevent a backflow of the molten material 73 more suitably.

Figure 6A:
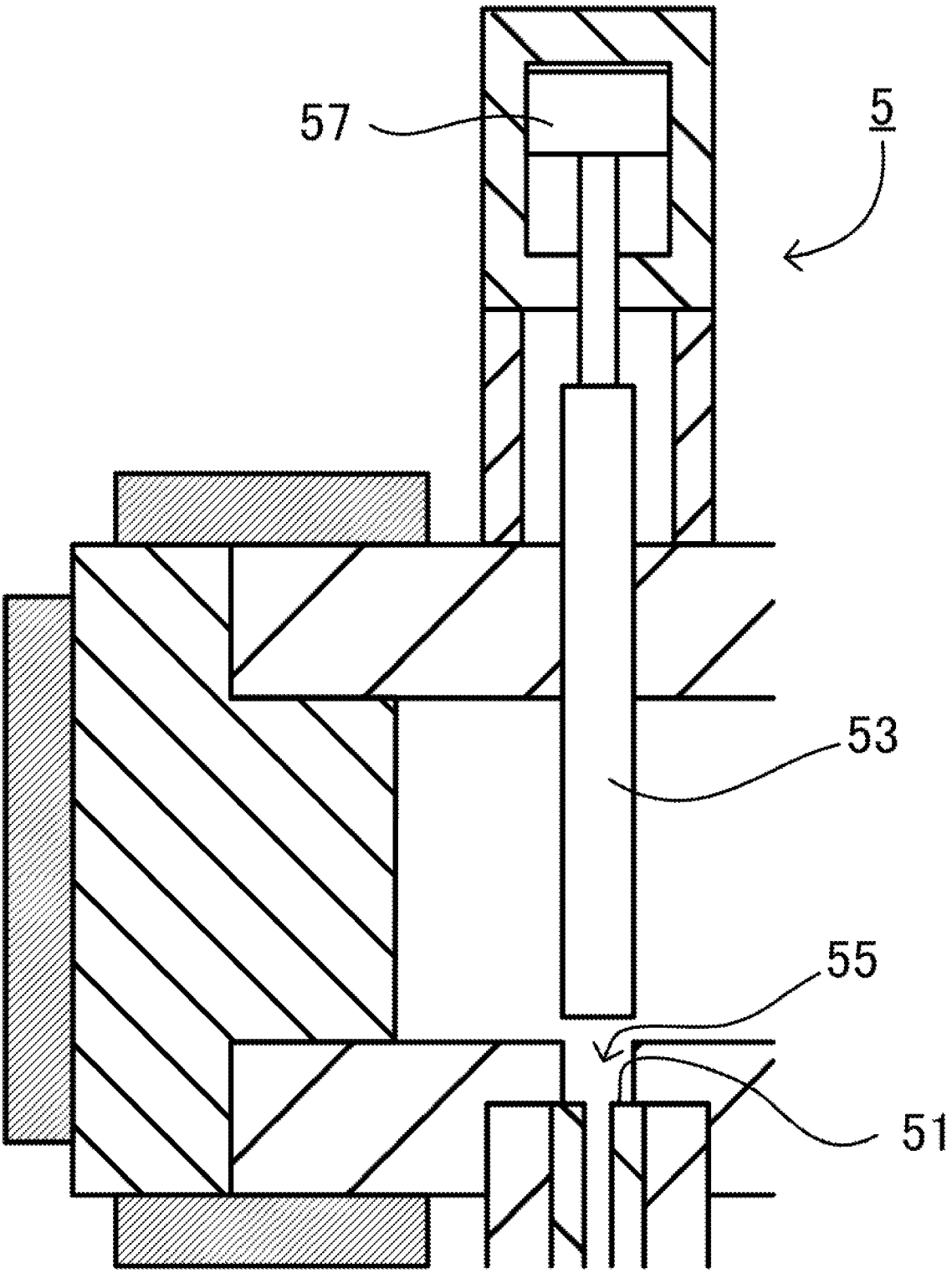
FIG. 6A is a diagram explaining a state in which a front of a valve rod 53 is not fitted to a fitting portion 55 in a pumping operation.
Figure 6B:
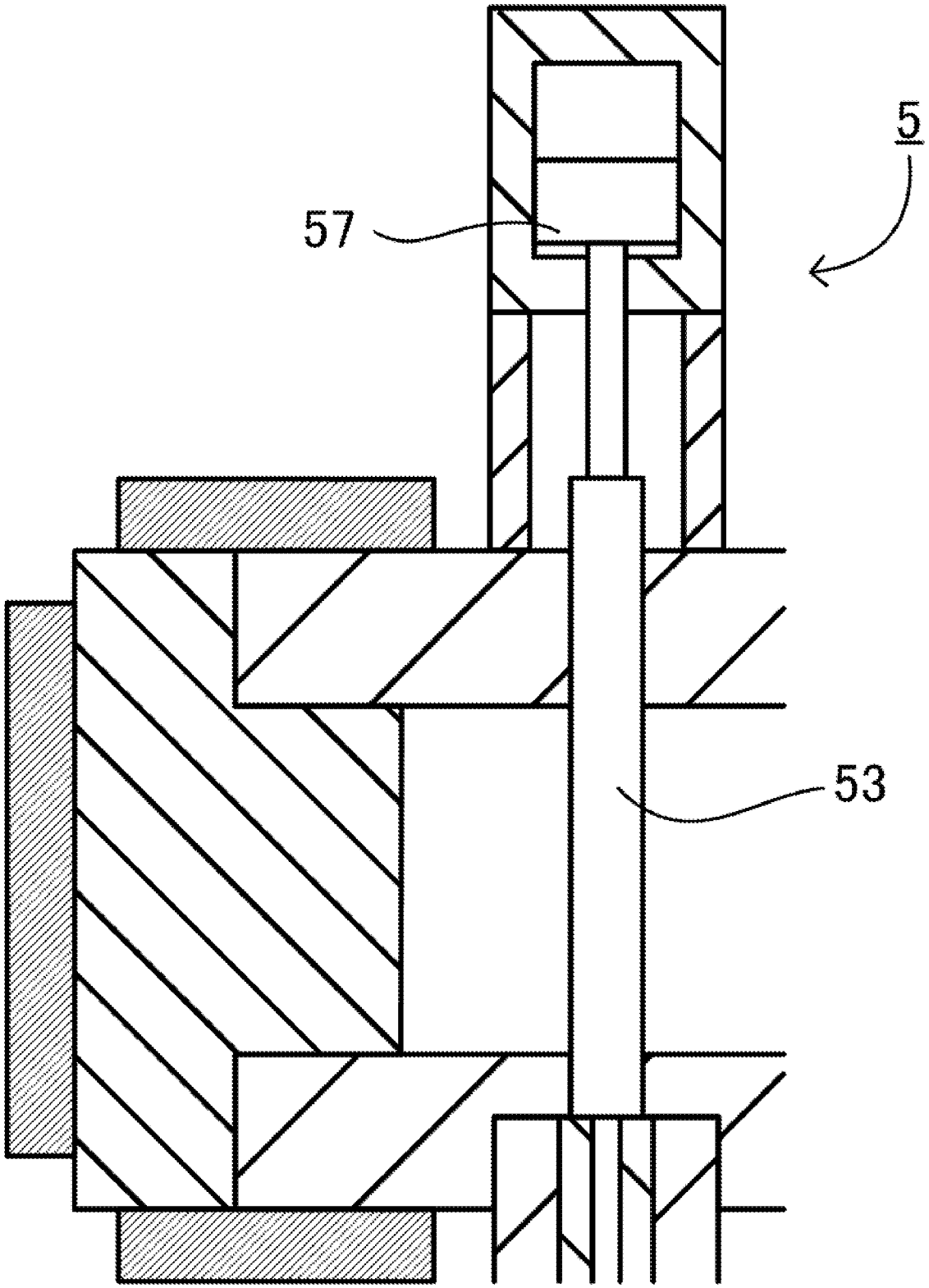
FIG. 6B is a diagram explaining a state in which a front of a valve rod 53 comes in contact with a sealing seat 51 in a pumping operation.

The backflow prevention operation in the injection molding machine according to the present example includes at least one pumping operation in which the front of the valve rod 53 moves from a position at which the front is not fitted to the fitting portion 55 to a position at which the front comes in contact with the sealing seat 51 as shown in FIGS. 6A and 6B. Preferably, the pumping operation is performed twice or more. As described above, the sealing seat 51 may be provided on the end face at the side of the melting device 2 in the communication path 41 or may be provided at the intermediate portion of the communication path 41. In either case, a direction in which the valve rod 53 moves in the pumping operation is from the side of the melting device 2 to the side of the injection device 3. In this manner, it is possible to push out the molten material 73 with low fluidity to the injection device 3, and it is possible to appropriately flow the molten material 73 from the melting device 2 to the injection device 3 when backflow prevention is released.

As described above, when the control device 6 recognizes that the molten material 73 is sent from the melting device 2 to the injection device 3, and a predetermined amount of the molten material 73 is metered, the backflow prevention operation is performed to close the communication path 41 before the injection operation is performed. A gas or the like may be mixed into the molten material 73 metered in the injection device 3, and a metering value recognized by the control device 6 and an actual metering value do not match in some cases. Therefore, after the backflow prevention device 5 performs the backflow prevention operation, the control device 6 advances the injection shaft 31 with a suitable pressure at which no injection is performed, and corrects a stop position of the injection shaft 31 as the actual metering position. Here, since heat of the front of the injection nozzle 35 is absorbed by the mold in contact therewith, the molten material 73 is solidified to form a stopper called a cold plug. Therefore, when the injection shaft 31 advances with a pressure that is about half of a minimum injection pressure necessary for injection or less, correction is performed without injecting the molten material 73 from the injection nozzle 35.

The present invention is particularly effective for an injection molding machine in which the molten material 73 with low fluidity is likely to be generated, for example, the front of the valve rod 53 of the backflow prevention device 5 is cooled. In addition, the present invention is particularly effective for an injection molding machine which supplies the molten material 73 into the injection device 3 by force of gravity without actively applying a pressure using a piston or the like. In other words, the present invention is particularly effective when the molten material 73 is sent from the melting device 2 to the injection device 3 by self-weight of the molten material 73.

The invention described above is not limited to the above embodiments, and various modifications can be made based on the spirit and scope of the invention and they are not excluded from the scope of the invention. Particularly, specific devices having basic functions according to the spirit of the present invention are included in the present invention.

What is claimed is:

1. An injection molding machine comprising:

a melting device in which a molding material melts to generate a molten material;

an injection device including an injection shaft which injects the molten material supplied from the melting device;

a connecting member including a communication path communicating with the melting device and the injection device; and a backflow prevention device configured to perform a backflow prevention operation in which the communication path is closed to prevent a backflow of the molten material, wherein the backflow prevention device includes a sealing seat that is provided on an end face at a side of the melting device in the communication path, a valve rod that is movable to come in contact with the sealing seat, and a fitting portion in which the sealing seat as an end is fitted to the valve rod and which is a recess complementary in shape to a front of the valve rod, wherein the fitting portion is disposed on an upper side of the connecting member, and wherein the backflow prevention operation includes at least one pumping operation in which the valve rod moves from a position at which the front of the valve rod is not fitted to the fitting portion to a position at which the front of the valve rod comes in contact with the sealing seat.

2. The injection molding machine according to claim 1, wherein the molding material is a light metal.

3. The injection molding machine according to claim 2, wherein the molding material is a magnesium alloy or an aluminum alloy.

4. The injection molding machine according to claim 1, wherein the backflow prevention operation includes the pumping operation performed at least twice.

5. The injection molding machine according to claim 1, wherein the molten material is supplied from the melting device to the injection device by self-weight of the molten material.

6. The injection molding machine according to claim 1, wherein the temperature of the front of the valve rod is lower than the temperature of the molten material by 30° C. or more and 50° C. or less.

7. The injection molding machine according to claim 1, wherein a cross-sectional area of the fitting portion is larger than a cross-sectional area of the communication path.

8. The injection molding machine according to claim 1, further comprising a control device configured to advance the injection shaft with a suitable pressure at which no injection is performed after the backflow prevention device performs the backflow prevention operation and correct a stop position of the injection shaft as an actual metering position.

9. The injection molding machine according to claim 8, wherein the suitable pressure is a pressure that is half of a minimum injection pressure necessary for injection or less.

10. An injection molding machine comprising:

a melting device in which a molding material melts to generate a molten material;

an injection device including an injection shaft which injects the molten material supplied from the melting device;

a connecting member including a communication path communicating with the melting device and the injection device; and a backflow prevention device configured to perform a backflow prevention operation in which the communication path is closed to prevent a backflow of the molten material, wherein the backflow prevention device includes a sealing seat that is provided at an intermediate portion of the communication path, a valve rod that is movable to come in contact with the sealing seat, and a fitting portion in which the sealing seat as an end is fitted to the valve rod and which is a recess complementary in shape to a front of the valve rod, and wherein the backflow prevention operation includes at least one pumping operation in which the valve rod moves from a position at which the front of the valve rod is not fitted to the fitting portion to a position at which the front of the valve rod comes in contact with the sealing seat.

11. The injection molding machine according to claim 10, wherein the communication path includes an upper communication path which is connected to the inciting device, an intermediate communication path which is connected to the upper communication path and in which the sealing seat is provided, and a lower communication path which is connected to the intermediate communication path and the injection device, and wherein the melting device and the upper communication path are connected at a center of a first connection surface connecting the melting device and the connecting member, and the injection device and the lower communication path are connected at a center of a second connection surface connecting the injection device and the connecting member.

* * * * *